US008132882B2

(12) United States Patent
Suzuki

(10) Patent No.: US 8,132,882 B2
(45) Date of Patent: Mar. 13, 2012

(54) RECORDING APPARATUS

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 386 days.

(21) Appl. No.: 12/388,503

(22) Filed: Feb. 18, 2009

(65) Prior Publication Data

US 2009/0207202 A1 Aug. 20, 2009

(30) Foreign Application Priority Data

Feb. 18, 2008 (JP) ..... 2008-035773

(51) Int. Cl.
*B41J 29/393* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 5,777,649 | A | 7/1998 | Otsuka et al. | |
| 5,943,073 | A | 8/1999 | Otsuka et al. | |
| 6,331,052 | B1 | 12/2001 | Murai et al. | |
| 2001/0050696 | A1 | 12/2001 | Suzuki et al. | |
| 2005/0035986 | A1* | 2/2005 | Iwao et al. | 347/10 |
| 2005/0104913 | A1 | 5/2005 | Sanada | |
| 2006/0007260 | A1* | 1/2006 | Oku | 347/19 |
| 2007/0103500 | A1 | 5/2007 | Ootsuka | |
| 2007/0263036 | A1 | 11/2007 | Ito | |

FOREIGN PATENT DOCUMENTS

| | | | |
|---|---|---|---|
| EP | 0652106 | A2 | 5/1995 |
| EP | 0974464 | A2 | 1/2000 |
| EP | 1707362 | A2 | 10/2006 |
| JP | H06-210872 | A | 8/1994 |
| JP | H10-006526 | A | 1/1998 |
| JP | 2001-232787 | A | 8/2001 |
| JP | 2005-059441 | A | 3/2005 |
| JP | 2007-301844 | A | 11/2007 |
| JP | 2007-304651 | A | 11/2007 |

OTHER PUBLICATIONS

Japan Patent Office; Notification of Reason for Refusal in Japanese Patent Application No. 2008-035773 (counterpart to the above-captioned U.S. patent application) mailed Apr. 20, 2010.

European Patent Office; Extended European Search Report in Patent Application No. 090022070.0 (counterpart to the above-captioned U.S. patent application) mailed Jun. 10, 2009.

* cited by examiner

*Primary Examiner* — Laura Martin
(74) *Attorney, Agent, or Firm* — Baker Botts L.L.P.

(57) ABSTRACT

A recording apparatus includes a recording head having a common liquid channel; plural pressure chambers; plural nozzles; plural individual liquid channels, each individual liquid channel extending from the common liquid channel via associated pressure chamber to associated nozzle; and plural actuators configured to impart a pressure to a liquid inside a respective one of the pressure chambers; and a control unit configured to drive the actuators; wherein the control unit comprises: an excessive state detection section configured to detect an excessive state in which a pressure difference between a liquid-side pressure and an air-side pressure at a meniscus formed at any one of the nozzles exceeds a threshold value when droplets are ejected from the nozzles, and a meniscus vibration section configured to drive the actuator associated with the nozzle that does not eject droplets such that the meniscus is subjected to vibration without ejecting the droplets.

9 Claims, 11 Drawing Sheets

RECORDING APPARATUS

CROSS REFERENCE TO RELATED APPLICATION

The present application claims priority from Japanese Patent Application No. 2008-035773, which was filed on Feb. 18, 2008, the disclosure of which is herein incorporated by reference in its entirety.

TECHNICAL FIELD

Apparatuses and devices consistent with the present invention relate to recording apparatuses and, more particularly, to recording apparatuses which eject droplets to record an image on a recording medium.

BACKGROUND

A known inkjet recording apparatus includes an inkjet head having a common ink channel to which inks are supplied from an ink tank and a plurality of individual ink channels extending from an outlet of the common ink channel to a nozzle ejecting ink droplets to a recording medium to record an image.

SUMMARY

In the above-described inkjet head, inks inside the common ink channel are made negative in pressure due to a short supply of inks to individual ink channels upon simultaneous ejection of ink droplets from multiple nozzles, and in particular, there is a case where a meniscus formed at a nozzle which does not eject ink droplets may be collapsed. If the meniscus is collapsed, ink droplets will not be normally ejected from the corresponding nozzle. Thus, an idea has been considered that a channel is increased in cross-sectional area to decrease the channel resistance at a common ink chamber, thereby dissolving the short supply of inks to the individual ink channels. However, when the common ink channel is increased in cross-sectional area, an inkjet head is made larger in size.

Accordingly, a need has arisen for a recording apparatus capable of downsizing a recording head and preventing a meniscus formed at a nozzle from being collapsed.

According to the present invention, there is provided a recording apparatus comprising: a recording head comprising: a common liquid channel; a plurality of pressure chambers; a plurality of nozzles; a plurality of individual liquid channels, each of the individual liquid channels being associated with a respective one of the pressure chambers and a respective one of the nozzles, each individual liquid channel extending from an outlet of the common liquid channel via the associated pressure chamber to the associated nozzle; and a plurality of actuators, each of the actuators being associated with the respective one of the pressure chambers and configured to impart a pressure to a liquid inside the respective one of the pressure chambers; and a control unit that is configured to drive the actuators; wherein the control unit comprises: an excessive state detection section that is configured to detect an excessive state in which a pressure difference between a liquid-side pressure and an air-side pressure at a meniscus formed at any one of the nozzles exceeds a threshold value when droplets are ejected from the nozzles, and a meniscus vibration section that is configured to drive the actuator associated with the nozzle that does not eject droplets such that the meniscus formed at the nozzle that does not eject droplets is subjected to vibration without ejecting the droplets for a predetermined vibration time from a start of the excessive state when the excessive state detection unit detects the excessive state.

According to the present invention, when a large amount of liquid is ejected from nozzles to develop a negative pressure inside a common ink channel, a meniscus formed at a nozzle which will not eject droplets, among the nozzles communicatively connected to the common ink channel, is vibrated to increase the pressure resistance of the corresponding meniscus, thus making it possible to downsize a recording head and also prevent the meniscus from being collapsed.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

Hereinafter, a description will be given for exemplary embodiments of the present invention by referring to drawings.

<First Exemplary Embodiment>

Figure 1:
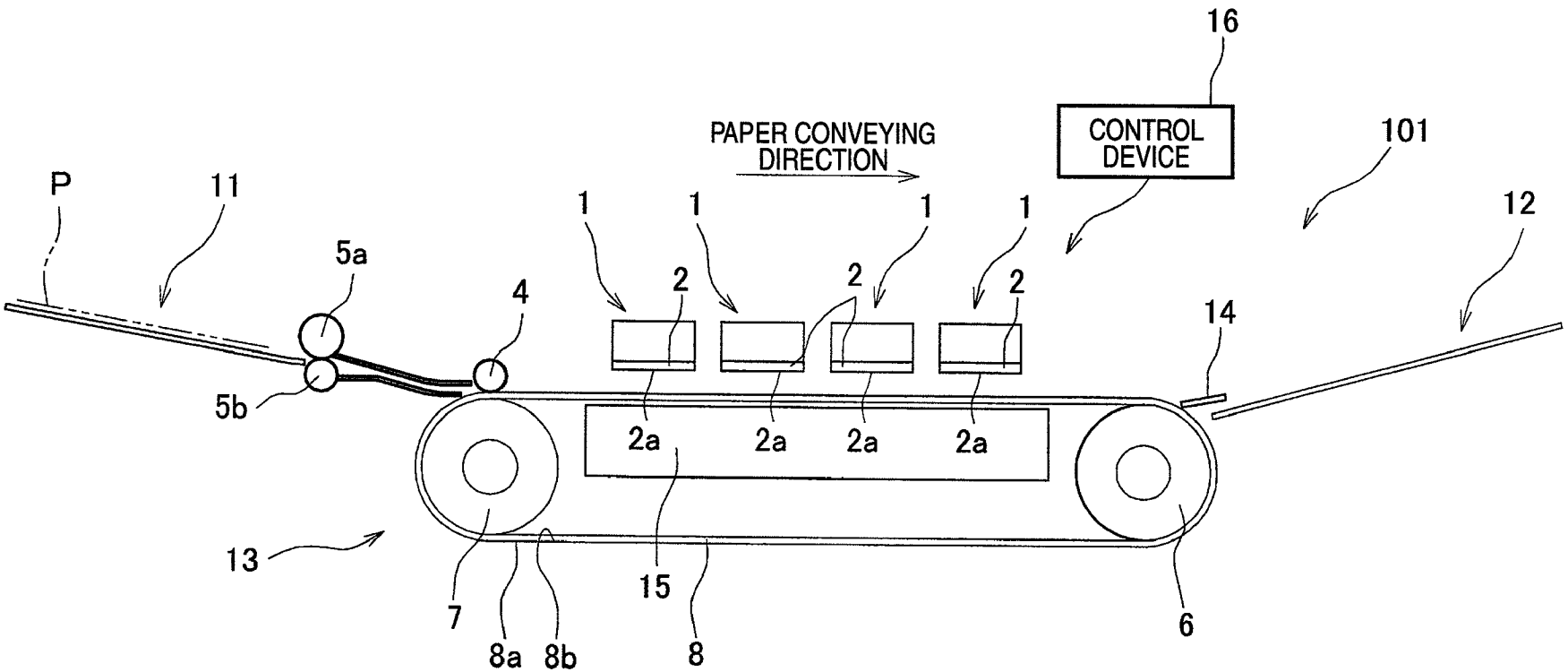
FIG. 1 is a side view showing an appearance of the inkjet printer of the first exemplary embodiment in the present invention.

FIG. 1 is a schematic side view showing an overall constitution of an inkjet printer of a first exemplary embodiment of the present invention. As shown in FIG. 1, the inkjet printer 101 is a color inkjet printer having four inkjet heads 1. The inkjet printer 101 includes a paper feeding unit 11 and a paper discharge unit 12 which are given respectively on the left side and on the right side of the drawing.

A paper conveying path through which paper P is conveyed from the paper feeding unit 11 to the paper discharge unit 12 is formed inside the inkjet printer 101. A pair of feeding rollers 5*a*, 5*b* for holding the paper therebetween and conveying it are arranged directly downstream from the paper feeding unit 11. The pair of feeding rollers 5*a*, 5*b* are configured to send out the paper P from the paper feeding unit 11 to the right side in the drawing. A conveying mechanism 13 is provided at an intermediate part of the paper conveying path.

The conveying mechanism 13 includes two belt rollers 6, 7, an endless conveying belt 8 which is wound so as to be laid between these two rollers 6, 7, and a platen 15 arranged at a region enclosed by the conveying belt 8. The platen 15 is to support the conveying belt 8 so that the conveying belt 8 will not sag downward at a position facing the inkjet head 1. A nip roller 4 is arranged at a position facing the belt roller 7. The nip roller 4 is to press down to an outer peripheral surface 8*a* of the conveying belt 8 the paper P sent out from the paper feeding unit 11 by the feeding rollers 5*a*, 5*b*.

A conveying motor 19 (refer to FIG. 6) allows the belt roller 6 to rotate, by which the conveying belt 8 is traveled. Thereby, the conveying belt 8 conveys paper P to the paper discharge unit 12, while adhesively retaining the paper P pressed down to the outer peripheral surface 8*a* by the nip roller 4. It is noted that a silicon resin layer which is slightly adhesive is formed on the surface of the conveying belt 8.

A peeling plate 14 is provided downstream from the conveying belt 8. The peeling plate 14 is configured to peel the paper p adhesively adhered on the outer peripheral surface 8*a* of the conveying belt 8 from the outer peripheral surface 8*a* and guide it to the paper discharge unit 12 on the right side in the drawing.

The four inkjet heads 1 are arrayed and fixed along a conveying direction so as to correspond to inks of four colors (magenta, yellow, cyan, and black). Specifically, the inkjet printer 101 is a line-type printer. Each of the inkjet heads 1 is provided at the lower end thereof with a head main body 2. The head main body 2 is formed in a long narrow rectangular-solid shape in a direction orthogonal to the conveying direction. Further, the bottom face of the head main body 2 is given as an ink ejection surface 2*a* which faces to the outer peripheral surface 8*a* of the conveying belt 8. When paper P conveyed by the conveying belt 8 passes sequentially directly below these four head main bodies 2, each color ink is ejected from the ink ejection surface 2*a* to the upper surface of the paper P, that is, a surface to be printed, thereby forming a desired color image on the surface to be printed of the paper P.

Figure 2:
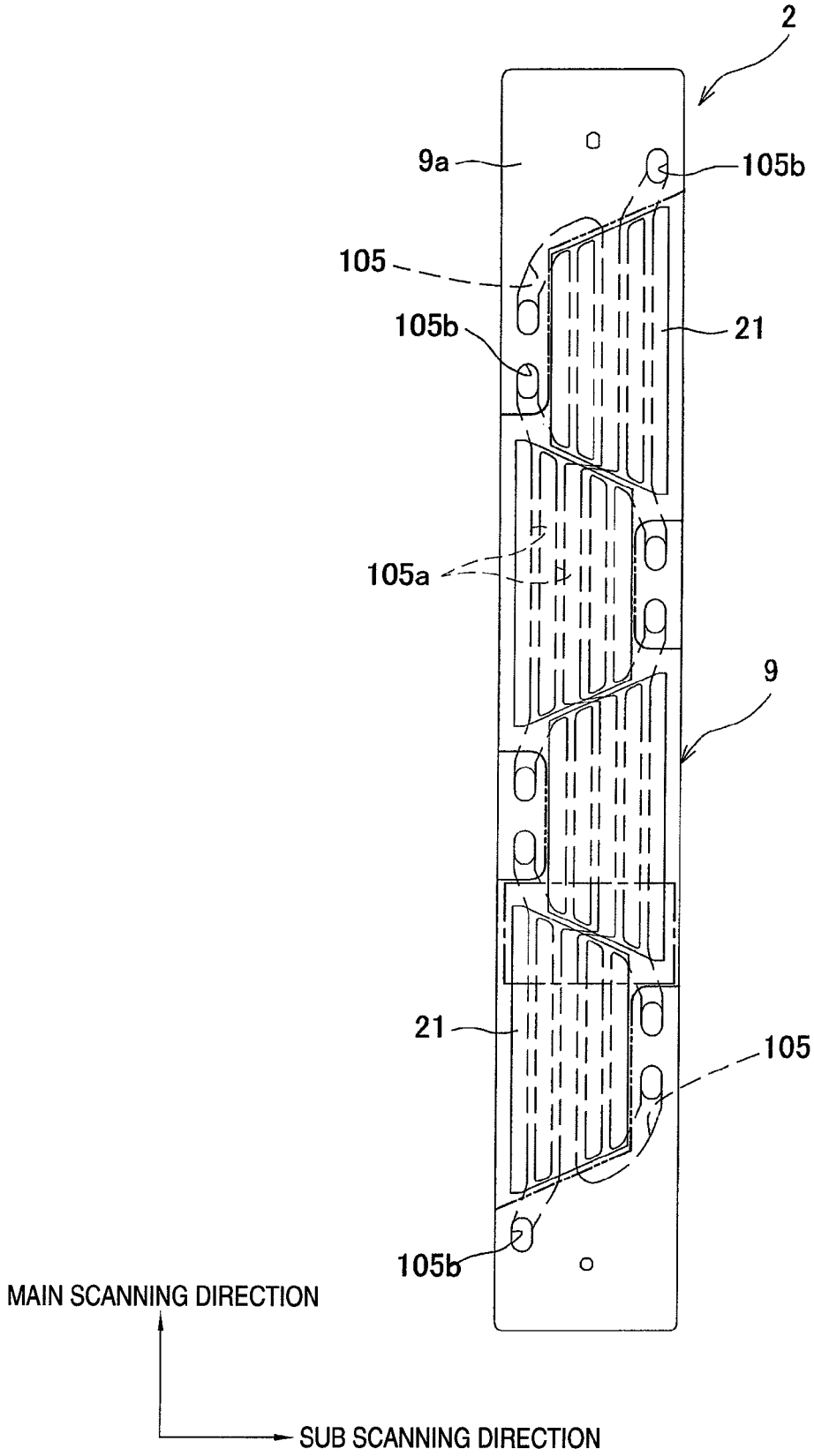
FIG. 2 is a plan view of a head main body.
Figure 3:
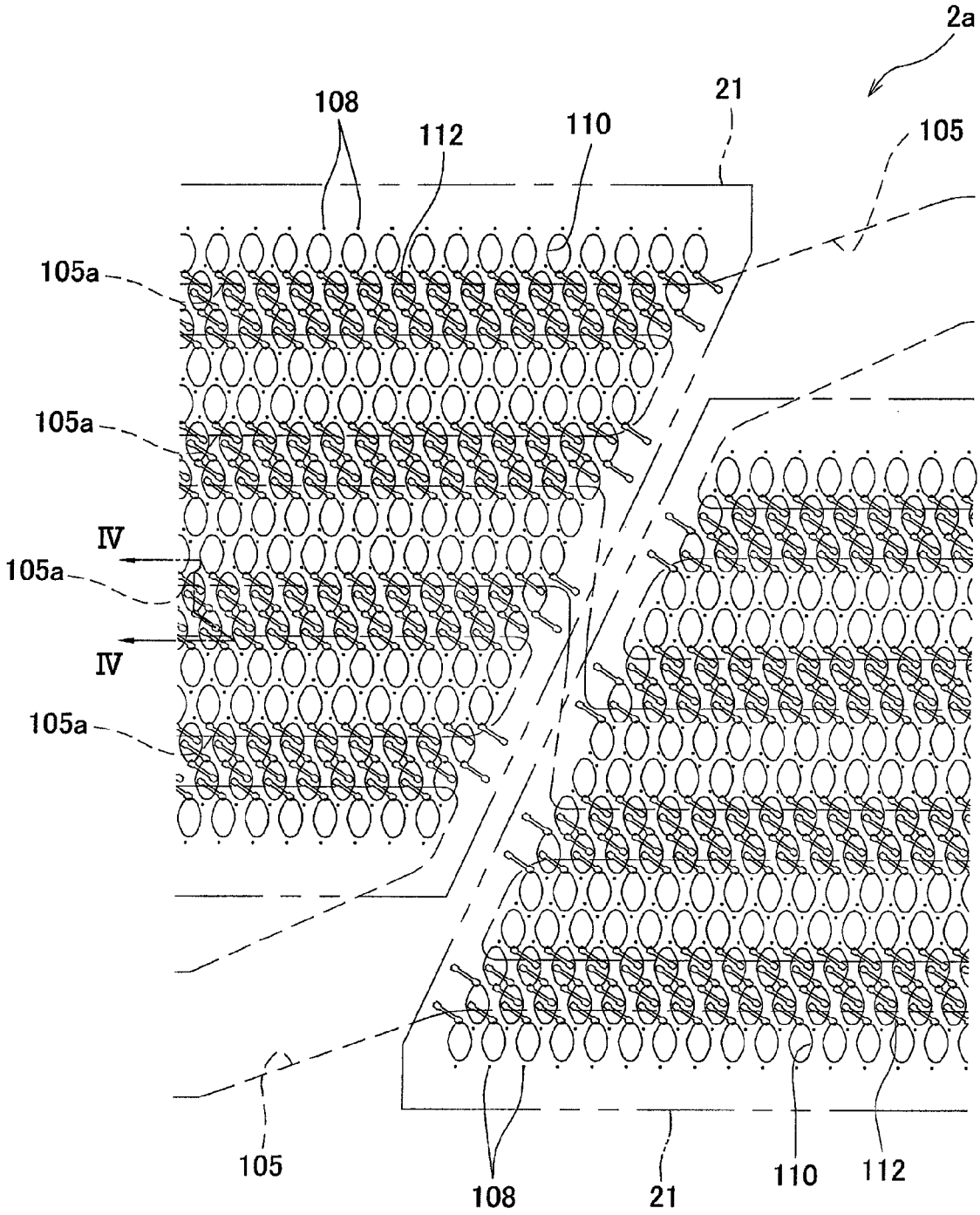
FIG. 3 is an enlarged view of a region enclosed by the single dotted and dashed line shown in FIG. 2.
Figure 4:
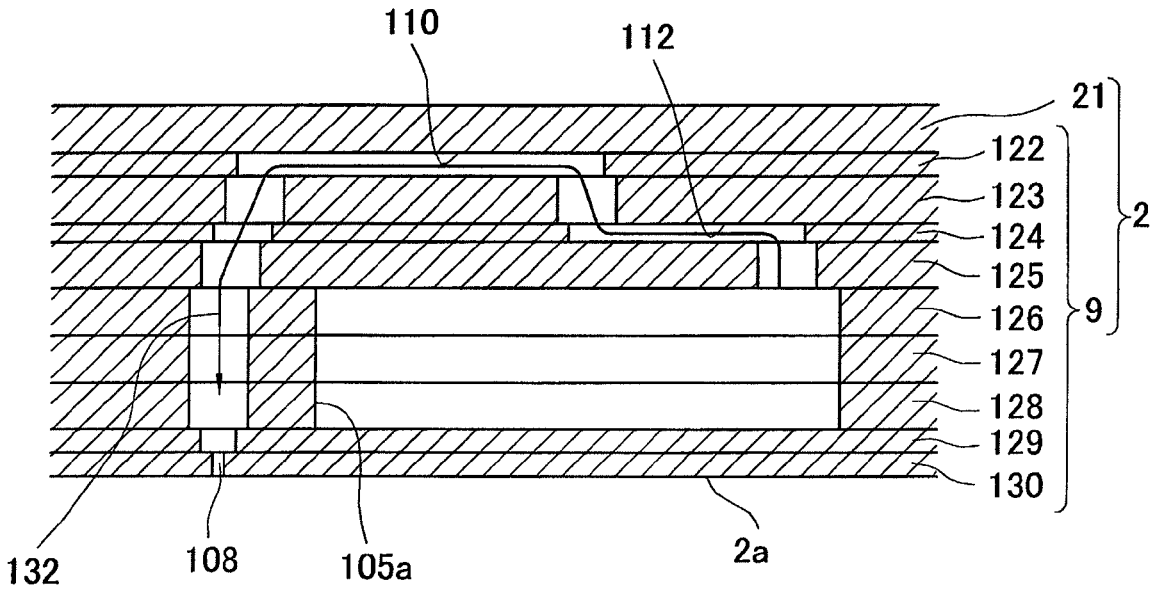
FIG. 4 is a cross sectional view taken along line IV-IV in FIG. 3.
Figure 5:
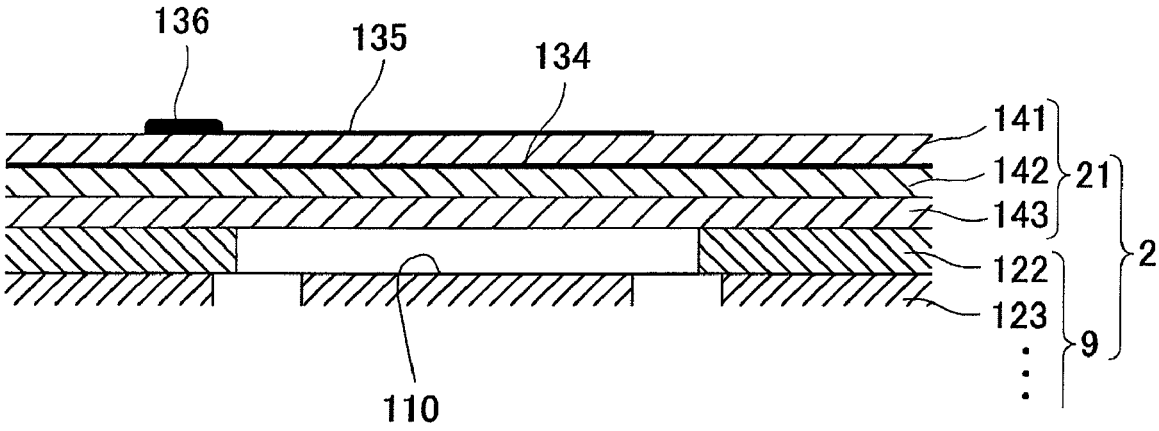
FIG. 5 is a cross sectional view of an actuator unit shown in FIG. 2.

Next, a description will be given for the head main body 2 by referring to FIG. 2 to FIG. 5. FIG. 2 is a plan view of the head main body 2. FIG. 3 is an enlarged view showing a region enclosed by the single dotted and dashed line in FIG. 2. It is noted that for the sake of description, in FIG. 3, a pressure chamber 110, an aperture 112 and a nozzle 108, which are below an actuator unit 21 and should be indicated by a broken line, are actually indicated by a solid line. FIG. 4 is a partial cross sectional view taken along line IV to IV in FIG. 3. FIG. 5 is a partial cross sectional view of the actuator unit 21.

A reservoir unit which reserves inks from an ink tank and also supplies them to a channel unit 9 and a driver IC51 (refer to FIG. 6) which generates a driving signal to drive the actuator unit 21 are assembled in the head main body 2 to constitute the inkjet head 1.

As shown in FIG. 2, the head main body 2 is provided with four actuator units 21 fixed on the upper surface 9*a* of a channel unit 9. As shown in FIG. 3, an ink channel including a pressure chamber 110 is formed inside the channel unit 9. The actuator unit 21 includes a plurality of actuators corresponding to each of the pressure chambers 110, having functions of imparting selectively ejection energy to inks inside the pressure chamber 110 upon driving by the driver IC51.

As shown in FIG. 2, the channel unit 9 is formed in a rectangular solid shape. A total of ten ink supply ports 105*b* are opened on the upper surface 9*a* of the channel unit 9 so as to correspond to an ink flow-out channel of the reservoir unit. As shown in FIG. 2 and FIG. 3, two manifold channels 105 which are communicatively connected to five ink supply ports 105*b* arrayed in the longitudinal direction (main scanning direction) of the channel unit 9 near the end portion of the channel unit 9 in the width direction (sub-scanning direction) are respectively formed inside the channel unit 9. These two manifold channels 105 are independent of each other in the channel unit 9 and also communicatively connected of each other in the reservoir unit. Further, each of the manifold channels 105 is provided with a plurality of sub-manifold channels 105*a* which are branched so as to be parallel to each other and also to extend in a main scanning direction. An ink ejection surface 2*a* on which multiple nozzles 108 are arranged in a matrix shape is formed on the lower surface of the channel unit 9. Multiple pressure chambers 110 are also arrayed in a matrix shape on the fixed surface of the actuator unit 21 in the channel unit 9 as with the nozzles 108.

In the first exemplary embodiment, rows of the pressure chambers 110 placed at equal intervals in the longitudinal direction of the channel unit 9 are arrayed parallel to each other in the width direction in 16 columns. The pressure chambers 110 are arranged in such a manner that the number contained in each column of the pressure chambers is gradually decreased from the longer side to the shorter side corresponding to an outer shape (trapezoidal shape) of the actuator unit 21 to be described later. The nozzles 108 are also arranged as described above.

As shown in FIG. 4, the channel unit 9 is constituted with nine plates 122 to 130 made with a metal material such as stainless steel. These plates 122 to 130 have a rectangular flat face longer in the main scanning direction.

These plates 122 to 130 are stacked while positioned with respect to each other, by which through holes formed on the plates 122 to 130 are coupled to form two manifold channels 105 inside the channel unit 9. And, there are formed multiple individual ink channels 132 extending from an outlet of the sub-manifold channel 105*a* on each of the manifold channels 105 through the pressure chamber 110 to the nozzle 108.

Next, a description will be given for the flow of inks at the channel unit 9. Inks supplied from the reservoir unit via the ink supply port 105*b* inside the channel unit 9 are branched into the sub-manifold channel 105*a* at each of the manifold channels 105. Inks inside the sub-manifold channel 105*a* flow into each of the individual ink channels 132, leading to the nozzles 108 via an aperture 112 acting as a diaphragm and the pressure chamber 110.

A description will be given for the actuator unit 21. As shown in FIG. 2, each of the actuator units 21 is formed in a trapezoidal planar shape. Further, the actuator unit 21 is made with a ferroelectric ceramic material based on lead zirconium titanate (PZT). As shown in FIG. 5, the actuator unit is constituted with three piezoelectric sheets (piezoelectric layers) 141 to 143. An individual electrode 135 is formed at a position facing a pressure chamber 110 on the piezoelectric sheet 141. The individual electrode 135 is provided with an electrode part arranged so as to face the pressure chamber 110 and an extension part extended outside a region facing the pressure chamber 110, and a land 136 is formed on the extension part. A common electrode 134 formed all over the sheet is interposed between the piezoelectric sheet 141 (uppermost layer) and the piezoelectric sheet 142 beneath the uppermost layer.

The common electrode 134 is equally given a ground potential at regions corresponding to all of the pressure chambers 110. On the other hand, the individual electrode 135 is electrically connected via the driver IC51 and the land 136, and a driving signal is to be selectively input from the driver IC51. Specifically, in the actuator unit 21, a part held between the individual electrode 135 and the pressure chamber 110 is given as an individual actuator, thereby a plurality of actuators corresponding to the number of pressure chambers 110 are made.

Here, a description will be given for a method for driving the actuator unit 21. The piezoelectric sheet 141 is polarized in the thickness direction, and a part corresponding to the individual electrode 135 (electrode part) acts as an active part which sags by piezoelectric effects. Then, when the individual electrode 135 is given a potential different from that of the common electrode 134, an electric field is applied to the active part in a polarization direction. The active part will expand in the thickness direction and contract in a planar direction when equal to the electric field in the polarization direction. It is noted that a displacement amount in this instance is greater in the planar direction than in the thickness direction. As described above, the actuator unit 21 is a so-called unimorph-type actuator in which one piezoelectric sheet 141 most distant from the pressure chamber 110 is given as an active layer including an active part and two lower piezoelectric sheets 142, 143 closer to the pressure chamber 110 are given as a non-active layer. The piezoelectric sheets 141 to 143 are fixed to the upper surface of a cavity plate 122 which divides the pressure chamber 110. In this instance, when a difference between an electric field-applied part on the piezoelectric sheet 141 and the piezoelectric sheets 142, 143 therebelow is found in distortion to the planar direction, the piezoelectric sheets 141 to 143 are deformed as a whole (unimorph deformation) so as to rise inside the pressure chamber 110. Thereby, a pressure (ejection energy) is imparted to ink inside the pressure chamber 110, by which pressure waves are developed inside the pressure chamber 110. Then, the thus developed pressure waves are propagated from the pressure chamber 110 to the nozzle 108, thereby ink droplets are ejected from the nozzle 108.

Figure 9:
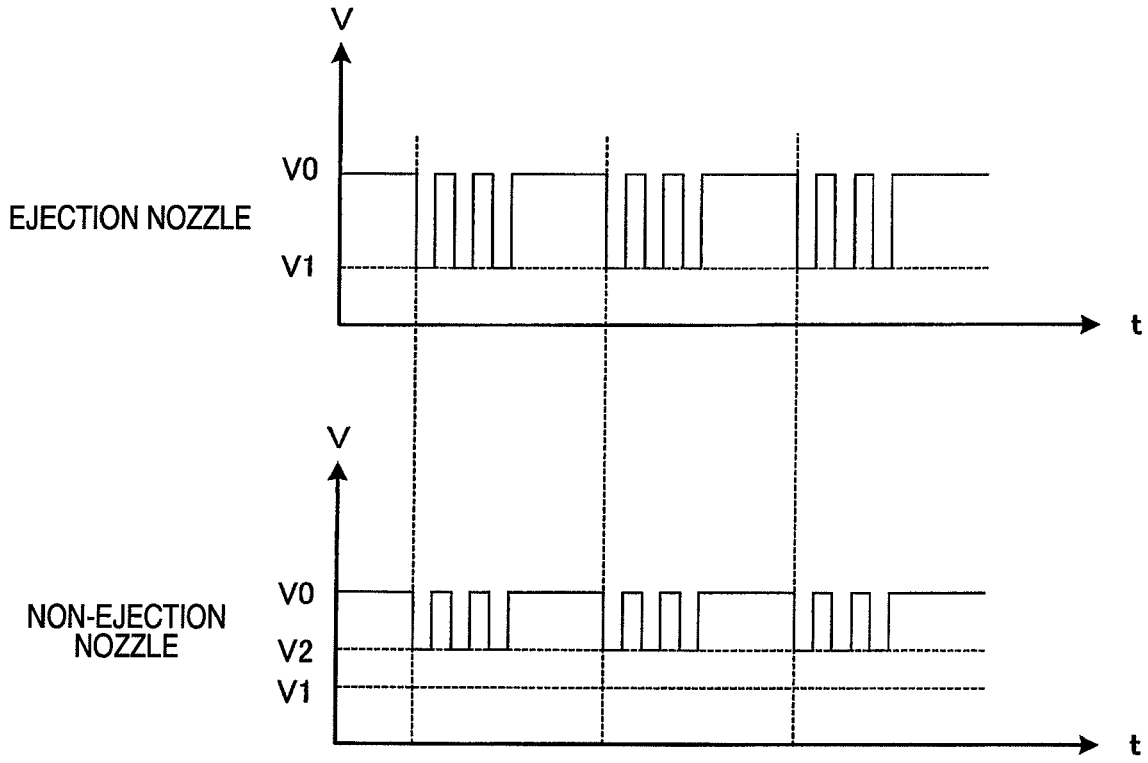
FIG. 9 is a drive waveform diagram for describing functions of a meniscus vibration section shown in FIG. 6.

In the first exemplary embodiment, a predetermined potential is imparted previously to the individual electrode 135, and a ground potential is temporarily imparted to the individual electrode 135 every time ejection is required, thereafter, a driving signal that imparts again a predetermined potential to the individual electrode 135 at a predetermined timing is output from the driver IC51 (refer to FIG. 9). In this instance, at a timing when the individual electrode 135 is given a ground potential, ink inside the pressure chamber 110 is decreased in pressure and sucked from a sub-manifold channel 105*a* into an individual ink channel 132. Thereafter, at a timing when the individual electrode 135 is again given a predetermined potential, the ink inside the pressure chamber 110 is increased in pressure and ink droplets are ejected from the nozzle 108. Specifically, a rectangular wave pulse is imparted to the individual electrode 135. The pulse width is AL (Acoustic Length), or the length of time during which pressure waves are propagated from an outlet of the sub-manifold channel 105*a* to the leading end of the nozzle 108 inside the pressure chamber 110, and when ink inside the pressure chamber 110 is reversed from a negative pressure state to a positive pressure state, both the pressures are combined, thus making it possible to eject ink droplets from the nozzle 108 at a great pressure.

Figure 6:
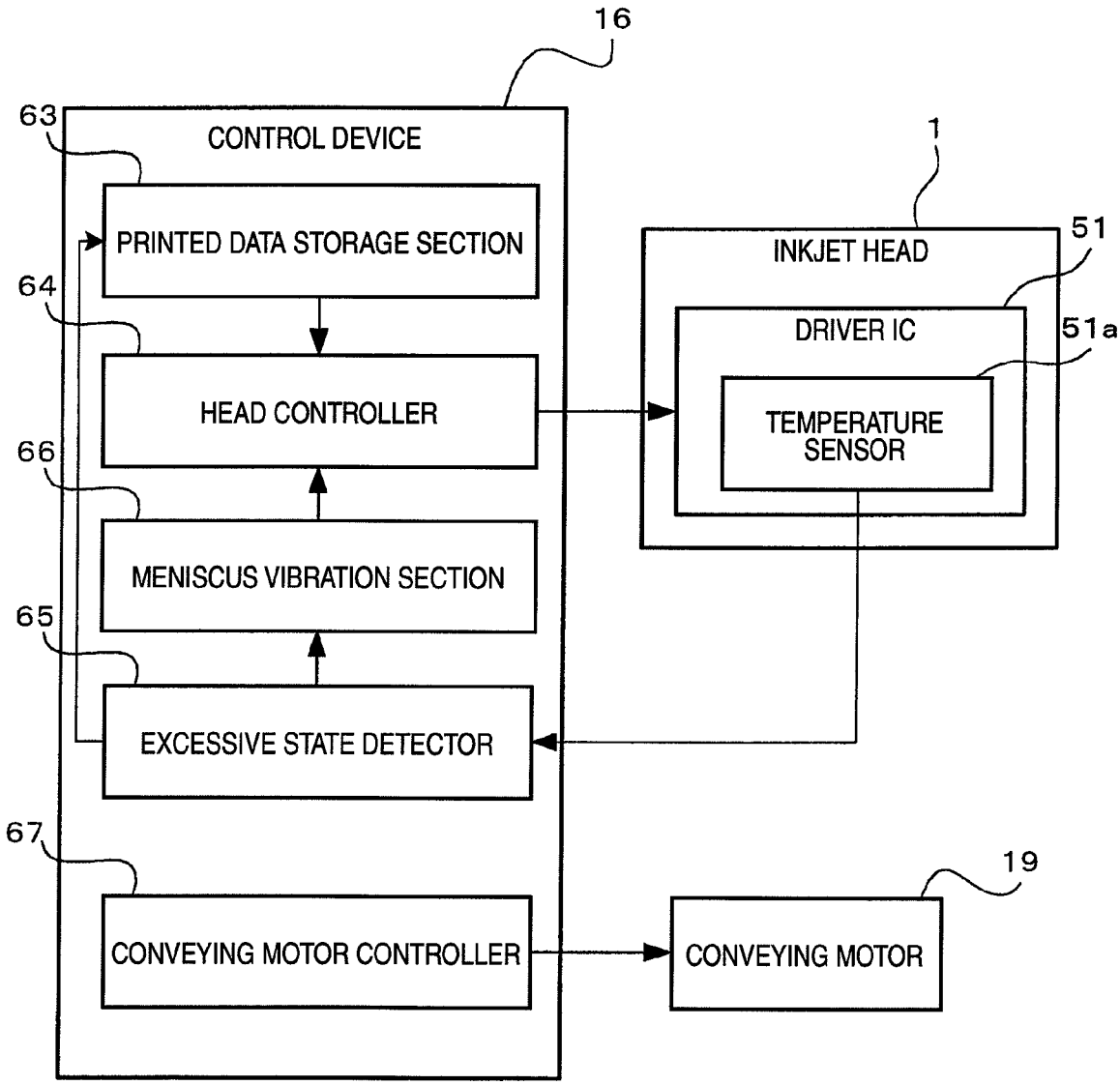
FIG. 6 is a function block diagram of a control device shown in FIG. 1.

Next, a detailed description will be given for a control device 16 by referring to FIG. 6. FIG. 6 is a functional block diagram of the control device 16. It is noted that FIG. 6 shows schematically only one of four inkjet heads 1. As shown in FIG. 6, the control device 16 is provided with a printed data storage section 63, a head controller 64, a conveying motor controller 67, an excessive state detector 65 and a meniscus vibration section 66.

The printed data storage section 63 is to store printed data transferred from a host computer. The printed data includes image data on an image to be formed on paper P. The image data is driving data by which the head controller 64 drives the actuator unit 21, or an aggregate of dot data showing sizes of droplets (large droplets, medium droplets, small droplets) ejected from nozzles 108 corresponding to each dot of an image.

The head controller 64 is to control the actuator unit 21 by outputting a control signal to the driver IC51. The head controller allows the nozzle 108 to eject ink droplets so that an image based on the printed data stored at the printed data storage section 63 is formed on paper P conveyed by the conveying mechanism 13. In this instance, an ejection cycle of ink droplets is determined by the conveying speed of the paper P and resolution with regard to the conveying direction of the paper P. In the first exemplary embodiment, the ejection cycle of ink droplets is set to be 20 kHz.

The conveying motor controller 67 is to control a driving speed of the conveying motor 19 so as to drive the conveying belt 8 at predetermined speed patterns (including acceleration pattern, constant speed pattern and slowdown pattern).

Figure 7:
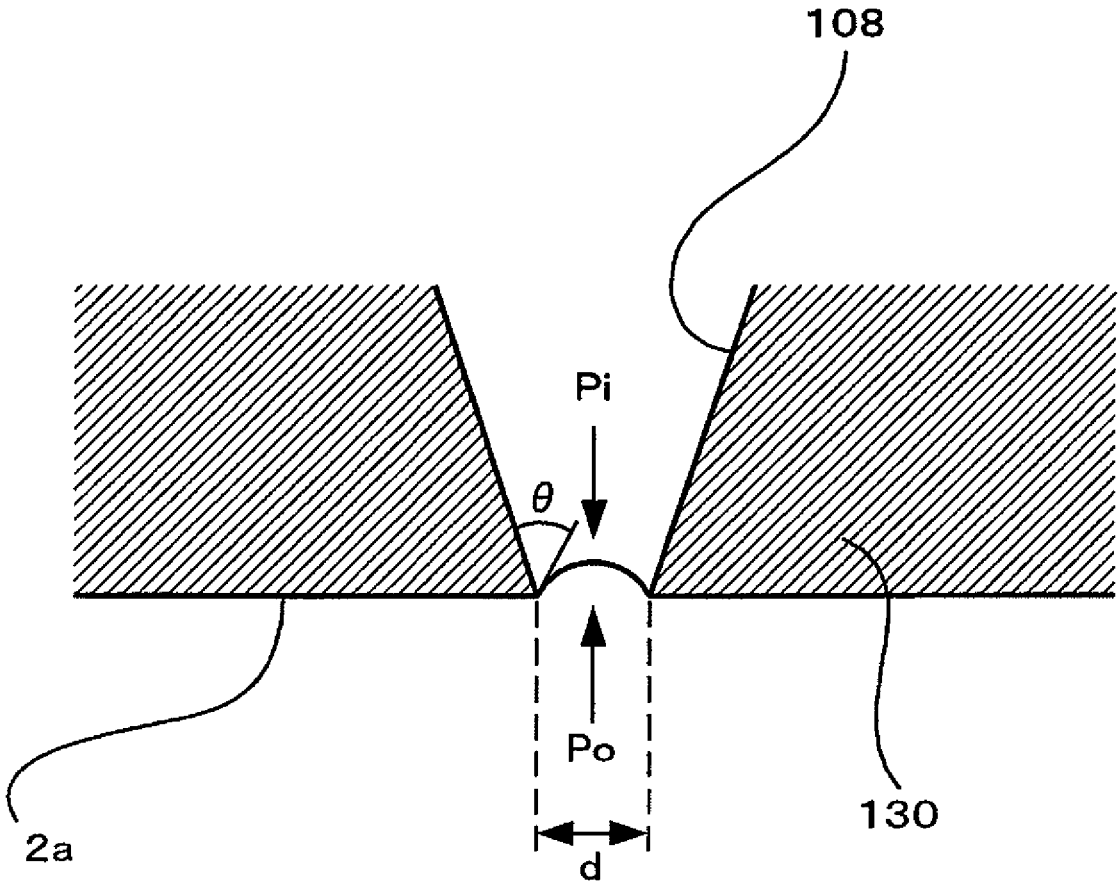
FIG. 7 is a cross sectional view of a nozzle plate showing a state of a meniscus formed at the nozzle in FIG. 4.
Figure 8:
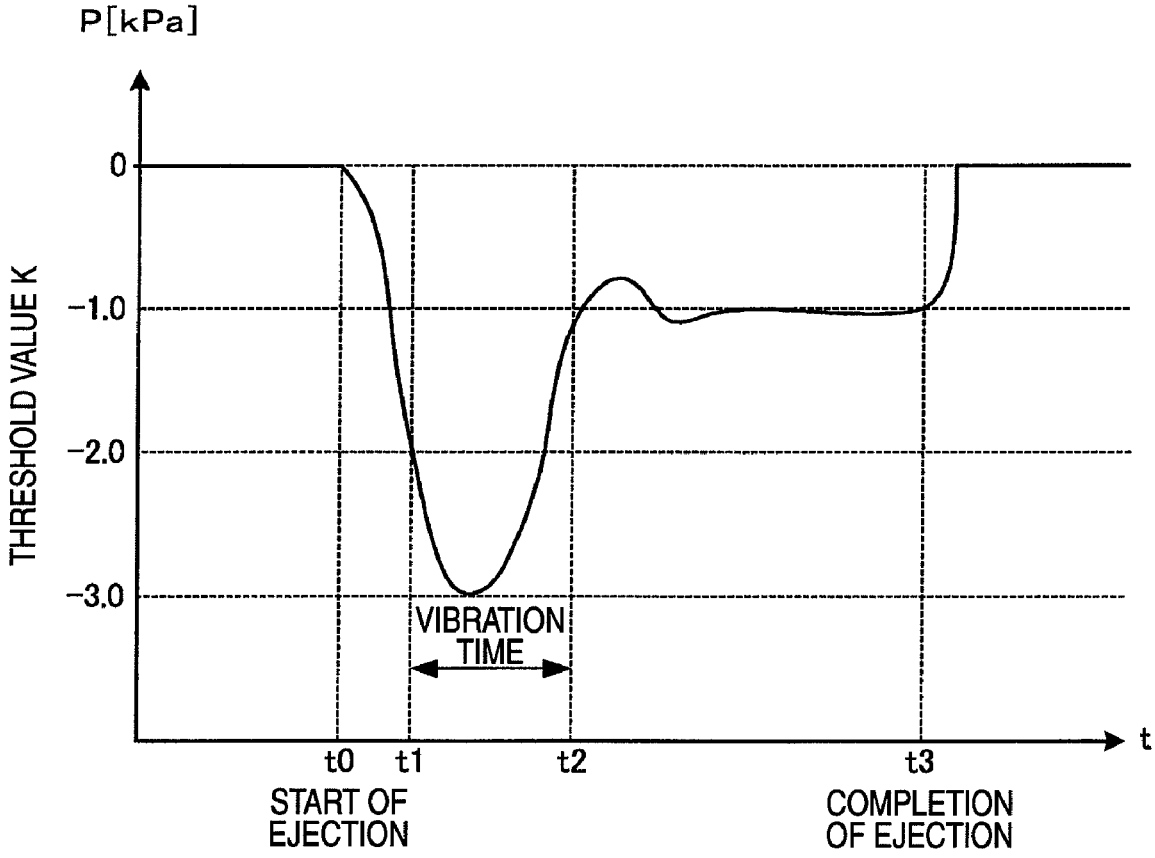
FIG. 8 is a graph showing the change in pressure of inks inside individual ink channels when a total amount of ink droplets ejected from the nozzle in FIG. 4 is changed so as to increase.

A description will be further given for the excessive state detector 65 by referring to FIG. 7 and FIG. 8. FIG. 7 is a cross sectional view of a nozzle plate 130 showing a state of a meniscus formed at the nozzle 108. In the first exemplary embodiment, when the actuator is in a non-driving state or a halt state, an ink-side pressure Pi is set to be slightly smaller than an air-side pressure Po. Therefore, the meniscus is constantly under a negative pressure from the ink side (corresponding to a water head pressure to be described later) and formed so as to rise inside the nozzle 108. FIG. 8 is a graph showing the change in pressure of inks inside a sub-manifold channel 105*a* and individual ink channels 132 when a total amount of ink droplets ejected from the nozzles 108 in unit time is changed so as to increase. When the actuator is driven to eject ink droplets and inks are not supplied in time, the meniscus is changed so as to rise further inside the nozzle 108. In this instance, the ink-side pressure Pi is greater in negative pressure. As shown in FIG. 7 and FIG. 8, the excessive state detector 65 is to estimate (detect) the fact that ink droplets are ejected from any one of the nozzles 108, by which a pressure difference Pd (Pd=Pi−Po) between the ink-side pressure Pi and the air-side pressure Po on the meniscus formed at the nozzle 108 is in an excessive state exceeding a threshold value k. When the pressure difference Pd exceeds the meniscus pressure resistance P that is a pressure at which the meniscus is collapsed, the meniscus formed at the nozzle 108 is collapsed, and ink droplets are less likely to be ejected normally from the nozzle 108 concerned. For example, ambient air enters into the nozzle 108 to result in ejection failure of ink droplets.

It is noted that the excessive state is a state that the pressure difference Pd is less than a meniscus pressure resistance P but exceeds a threshold value k (−2.0 kPa in the first exemplary embodiment) which is set to be a value close to the meniscus pressure resistance P. As described above, since the threshold value k is a threshold value for the purpose of preventing the meniscus from being collapsed, it is set so as to be less than the meniscus pressure resistance P. Further, if the nozzles 108 continue to eject ink droplets, as apparent from time t2 to time t3 in FIG. 8, a balance is developed between the consumption of inks from the nozzles 108 and the supply of inks to the sub-manifold channel 105*a* and the individual ink channel 132. At this time, pressure loss (negative pressure) takes place at the corresponding ink channels and the pressure loss is applied to a meniscus until the ejection of ink droplets is halted. If the pressure loss at this time is not that which will collapse the meniscus, the threshold value k may be set as a value more than the pressure difference Pd in the thus balanced state. Further, it is preferable that the threshold value k is set greater than the pressure difference Pd when there is a balance between the amount of inks ejected from all of the nozzles 108 and that of inks supplied from ink tanks (ink supply sources) upon ejection of maximum-size ink droplets ejected from all of the nozzles 108. Thus, there is no chance to start unnecessary vibration of the meniscus, which contributes to reduced consumption of electricity.

In this instance, the meniscus pressure resistance P is expressed by:

$$P=4\sigma\cdot\cos\theta/d$$

wherein

σ denotes ink surface tension

θ, ink contact angle at nozzle 108 and d, opening diameter of nozzle 108.

The ink surface tension σ will be increased with an increase in ink viscosity. The ink viscosity will be decreased with an increase in ink temperature T. Therefore, the meniscus pressure resistance P will be decreased with an increase in ink temperature T. As a result, the excessive state detector 65 increases a threshold value k with an increase in ink temperature T (the threshold value k is changed to the positive pressure side).

Then, the ink-side pressure Pi is expressed by:

$$Pi=P0+\Delta P$$

Wherein

P0 denotes water head pressure and

ΔP, pressure loss.

The water head pressure P0 is a pressure developed from a difference between an opening position of the nozzle 108 and a liquid level position of inks inside the ink tank in the perpendicular direction. Further, the pressure loss ΔP is expressed by:

$$\Delta P=Q\cdot R$$

Q denotes ink amount ejected from nozzle 108, and

R, channel resistance on ink channel from ink tank to nozzle 108.

Further, the channel resistance R is determined by the cross sectional shape of ink channel and ink viscosity μ. Still further, the ink viscosity μ will be changed depending on the ink temperature T. Therefore, the pressure difference Pd will be changed depending on the amount Q and the temperature T of inks ejected from the nozzle 108.

As shown in FIG. 8, for example, where a state that no ink droplets are ejected from any one of the nozzles 108 (to t0) is changed to a state that ink droplets are ejected in a great amount from most of the nozzles 108 (t0 to t3), inks are not supplied in time to the sub-manifold channel 105*a* and individual ink channels 132 until the flow of inks is made stable or t0 to t2. Thereby, the individual ink channels 132 are greatly in a negative pressure. In the case shown in FIG. 8, the pressure difference Pd is −3.0 kPa at the maximum. Where the meniscus pressure resistance P is −3.0 kPa and the pressure difference Pd is −3.0 kPa, a meniscus may be collapsed at a nozzle 108 from which no ink droplets are ejected.

The excessive state detector 65 calculates an ink temperature T inside the channel unit 9 on the basis of the result detected by a temperature sensor 51*a* provided on the driver IC51 and also calculates a variation amount V in a total amount of ink droplets ejected from all of the nozzles 108 which eject ink droplets at each ejection cycle (unit time) (corresponding to an ink amount Q at the start of ejecting ink droplets from a halt state of ejection of the ink droplets) on the basis of printed data stored at the printed data storage section 63.

Further, as described above, since the meniscus pressure resistance P is decreased with an increase in ink temperature T, the excessive state detector 65 shifts a threshold value k to the positive pressure side and increases the threshold value with an increase in ink temperature. Then, the excessive state detector 65 calculates a pressure difference Pd on the basis of the thus calculated ink temperature T and variation amount V and detects that the thus calculated pressure difference Pd is in an excessive state exceeding the threshold value k.

By further referring to FIG. 9, a meniscus vibration section 66 will be described. FIG. 9 is a drive waveform drawing for describing the function of the meniscus vibration section 66. As shown in FIG. 9, upon detection of an excessive state by the excessive state detector 65, the meniscus vibration section 66 drives actuator units 21 via a head controller 64 in such a manner that a meniscus formed at all of the nozzles 108 which do not eject ink droplets may be subjected to vibration without ejecting the ink droplets for the elapse of a predetermined vibration time from the start of the excessive state (t1 to t2).

Specifically, as shown in FIG. 9, when the head controller 64 imparts on the basis of printed data an ejection driving signal having a pulse of potential V1 at which ink droplets are ejected (a waveform which ejects large ink droplets having three continuous pulses at each ejection cycle unit of 20 kHz) to individual electrodes 135 on nozzles 108 which eject ink droplets, the meniscus vibration section 66 imparts a non-ejection driving signal having a pulse of potential V2 at which ink droplets are not ejected and also having the same waveform as the ejection driving signal to the individual electrodes 135 on nozzles 108 which do not eject ink droplets. Thereby, a meniscus formed at nozzles 108 which do not eject ink droplets is subjected to vibration. It is noted that the first exemplary embodiment is constituted so that the ejection driving signal and the non-ejection driving signal have the same waveform. However, the non-ejection driving signal may have any given waveform in which the meniscus is vibrated at a predetermined cycle. The non-ejection driving signal may have, for example, a waveform in which pulses are continuous independent of an ejection cycle. Alternatively, the non-ejection driving signal may have the same potential as that of the ejection driving signal and also may be of a waveform made up of pulses, the width of which is adjusted so that no ink droplets can be ejected.

According to findings of the inventor, a meniscus formed at nozzles 108 is subjected to vibration, by which the meniscus is increased in meniscus pressure resistance P. Therefore, there is no chance that the meniscus is collapsed while the meniscus is in vibration, even if the pressure difference Pd exceeds a meniscus pressure resistance P when the meniscus is not vibrated (−3.0 kPa in the first exemplary embodiment).

Further, the meniscus vibration section 66 determines the vibration time to be a sufficient length of time so that a pressure difference Pd can return to a value less than a threshold value k after exceeding the threshold value k. Therefore, the meniscus vibration section 66 lengthens the vibration time as the pressure difference Pd is increased.

According to the first exemplary embodiment so far described, the excessive state detector 65 calculates a pressure difference Pd between the ink-side pressure Pi and the air-side pressure Po in a meniscus formed at nozzles 108, thereby detecting an excessive state in which the thus calculated pressure difference Pd exceeds a threshold value k. Then, the meniscus vibration section 66 vibrates the meniscus at the nozzle 108 which does not eject ink droplets for the elapse of vibration time from the start of the excessive state. Thereby, in the excessive state, the corresponding meniscus is increased in meniscus pressure resistance P, making it possible to downsize the inkjet head 1 and also prevent the meniscus at the nozzle from being collapsed.

The excessive state detector 65 shifts a threshold value k to the positive pressure side to increase the threshold value with an increase in ink temperature. Therefore, even where an ink viscosity μ is changed depending on the ink temperature T, it is possible to determine the threshold value k appropriately and also improve temperature characteristics.

Further, since the excessive state detector 65 calculates a pressure difference Pd on the basis of the ink temperature T and a variation amount V in a total amount of ink droplets ejected from all of the nozzles 108 which eject ink droplets, it is possible to estimate accurately the pressure difference Pd.

Still further, since the excessive state detector 65 calculates the variation amount V on the basis of printed data stored at the printed data storage section 63, it is possible to estimate easily the pressure difference Pd.

In addition, since the meniscus vibration section 66 lengthens the vibration time with an increase in pressure difference Pd, it is possible to change time during which a meniscus is vibrated depending on the time during which a negative pressure exceeding a threshold value k or a meniscus pressure resistance P is found on individual ink channels 132. Thereby, the time during which the meniscus is vibrated is not lengthened unnecessarily but can be set appropriately to save the consumption of electricity.

<Exemplified Variation>

The first exemplary embodiment is constituted in such a manner that the inkjet head 1 corresponds to a single color ink and a one-color ink from a corresponding ink tank is supplied to two manifold channels 105 at a channel unit 9. However, such a constitution is also acceptable that the inkjet head corresponds to two color inks and the inks from two corresponding ink tanks are supplied respectively to mutually different manifold channels 105 at the channel unit 9. In this instance, each of the manifold channels 105 and a plurality of individual ink channels communicatively connected to the corresponding manifold channel 105 are given as one head unit. Then, the excessive state detector 65 calculates a variation amount V in a total amount of ink droplets ejected from all of the nozzles 108 which eject ink droplets in each ejection cycle at each head unit, calculates a pressure difference Pd for each head unit on the basis of the thus calculated ink temperature T and variation amount V, and detects an excessive state in which the thus calculated pressure difference Pd exceeds a threshold value k determined for each head unit. And the meniscus vibration section 66 determines the vibration time for each head unit to be a sufficient length of time so that the pressure difference Pd can return to a value less than a threshold value k after exceeding the threshold value k.

Accordingly, since an optimal threshold value k and optimal vibration time can be determined according to ink characteristics, it is possible to detect accurately an excessive state on individual ink channels 132 at each head unit.

<Second Exemplary Embodiment>

Figure 10:
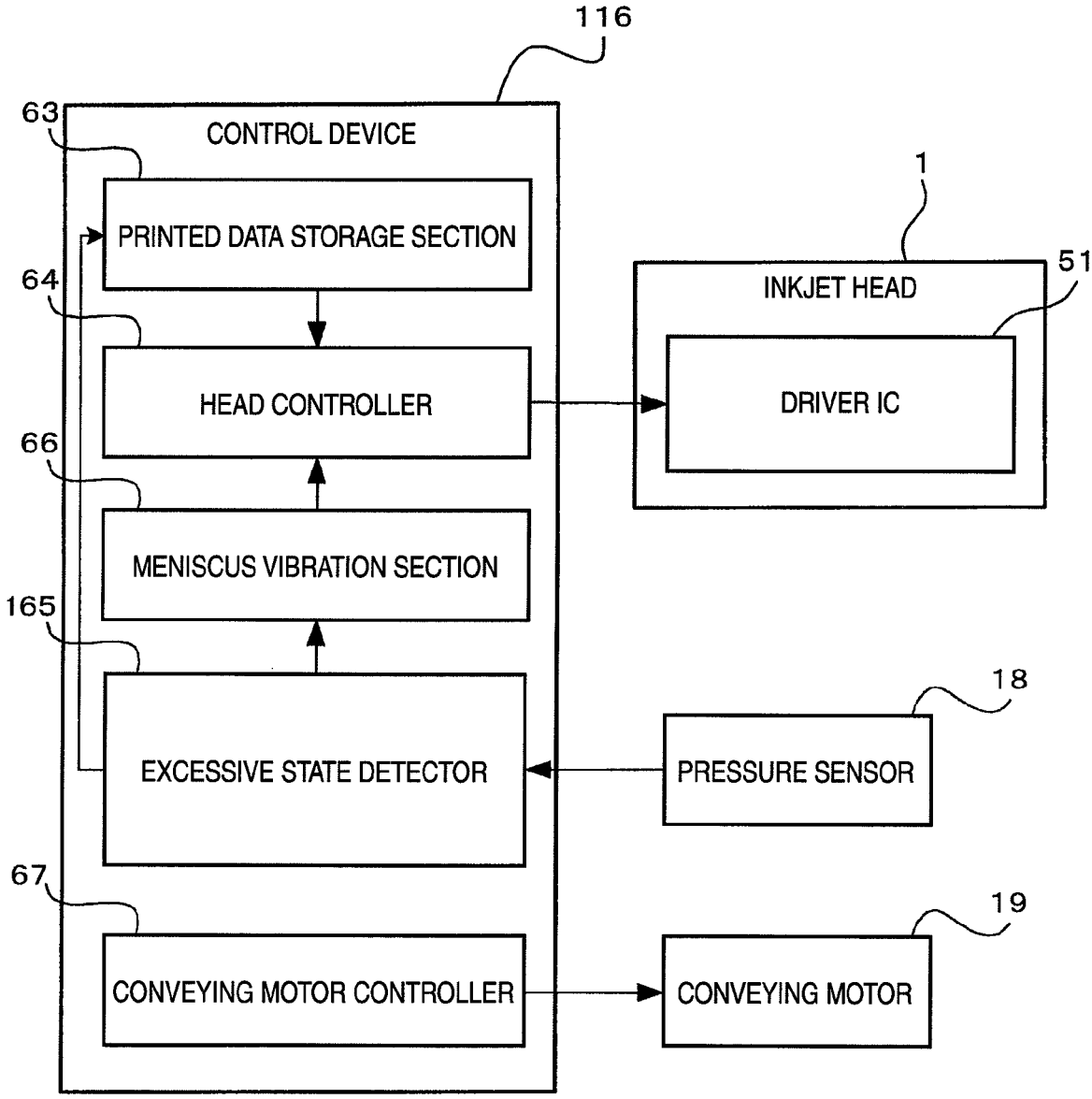
FIG. 10 is a function block diagram of a control device provided on the inkjet printer of the second exemplary embodiment.
Figure 11:
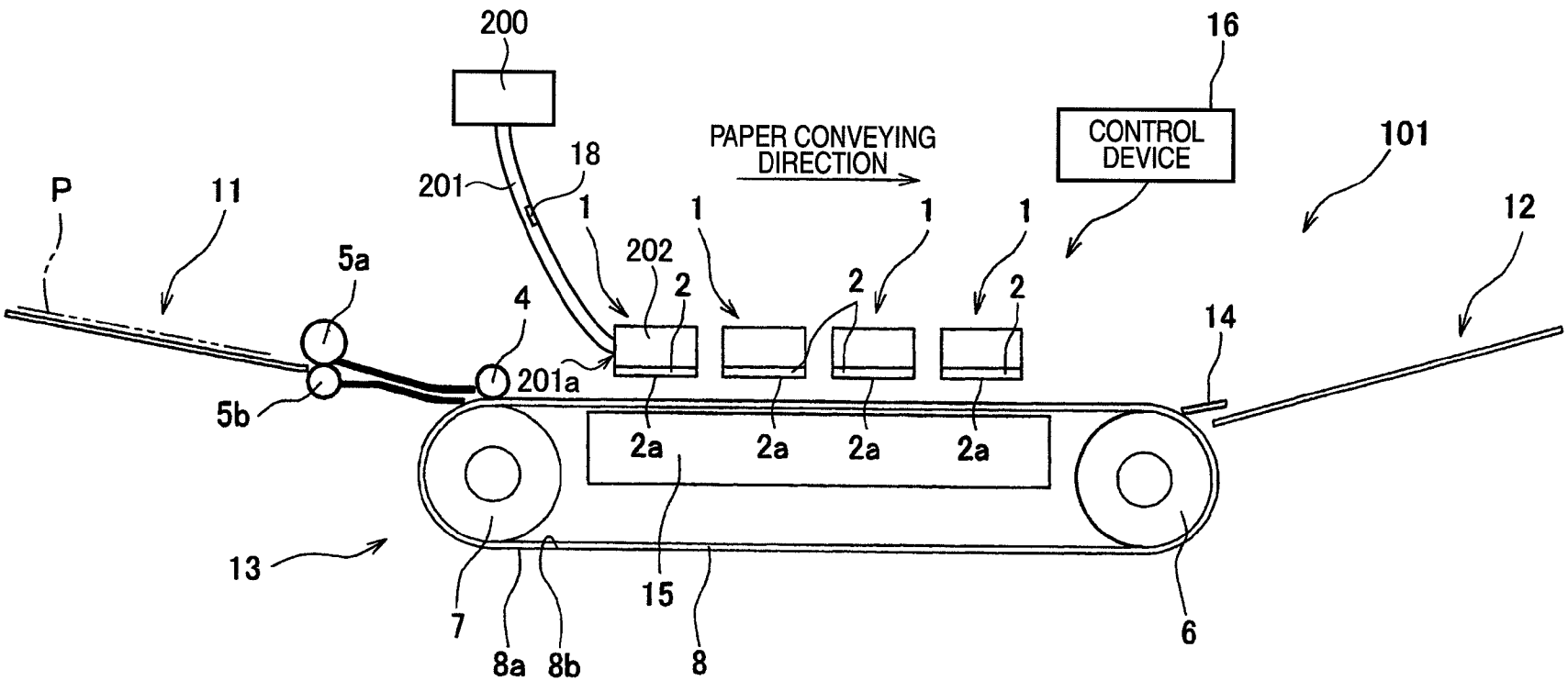
FIG. 11 is a side view showing an appearance of the inkjet printer of the second exemplary embodiment in the present invention.

A description will be given for a second exemplary embodiment of the present invention by referring to FIG. 10. FIG. 10 is a function block diagram of a control device used in the inkjet printer of the second exemplary embodiment. It is noted that the second exemplary embodiment is substantially similar to the first exemplary embodiment in members and function portions excluding the excessive state detector 165 of the control device 116 and the pressure sensor 18. Thus, these members and portions will be given the same reference numbers as those of the first exemplary embodiment and omitted for description.

The pressure sensor 18 is arranged inside an ink supply tube 201 for supplying inks of the ink tank 200 to the reservoir unit 202, detecting a pressure inside the ink supply tube 201. The excessive state detector 165 calculates a pressure difference Pd on the basis of the pressure inside the ink supply tube 201 detected by the pressure sensor 18 and detects an excessive state in which the thus calculated pressure difference Pd exceeds a threshold value k. In this instance, where large ink droplets are ejected from all nozzles 108 and there is balance between an amount of inks flowing from all of the nozzles 108 and an amount of inks supplied to the manifold channel 105, the threshold value k is more than a value corresponding to a pressure measured by the pressure sensor 18 and also less than a meniscus pressure resistance P.

It is noted that in view of measuring more accurately the pressure of inks inside the sub-manifold channel 105*a* and the common ink channel 132, the pressure sensor 18 may be arranged at a coupling part 201*a* of an ink supply tube with the reservoir unit 202 or on an ink channel inside the reservoir unit 202. Thereby, the change in ink-side pressure applied to a meniscus can be detected without temporal delay.

Then, where the excessive state detector 165 detects an excessive state, the meniscus vibration section 66 drives actuator units 21 via a head controller 64 in such a manner that a meniscus formed at all of the nozzles 108 that do not eject ink droplets can be subjected to vibration without ejecting ink droplets for the elapse of vibration time from the start of the excessive state.

According to the second exemplary embodiment so far described, when inks are ejected in a great amount from the nozzles 108 to develop a negative pressure on the individual ink channels 132, a meniscus formed at nozzles 108 from which no ink droplets are ejected is subjected to vibration, thereby the meniscus is increased in meniscus pressure resistance P. Thus, it is possible to downsize the inkjet head 1 and also prevent the meniscus from being collapsed.

Further, since the excessive state detector 165 calculates a pressure difference Pd on the basis of the pressure inside an ink supply tube detected by the pressure sensor 18, it is possible to detect accurately an excessive state.

A description has been so far given for exemplary embodiments of the present invention. However, the present invention shall not be limited to the above-described exemplary embodiments but may be modified in various ways within a scope of claims in the present invention. For example, the above-described first exemplary embodiment is constituted so that the meniscus vibration section 66 lengthens the vibration time with an increase in pressure difference Pd. However, such a constitution is also acceptable that the vibration time is fixed.

Further, the first exemplary embodiment is constituted so that the vibration time is determined to be a sufficient length of time so that a pressure difference Pd can return to a value less than a threshold value k after exceeding the threshold value k. Such a constitution may also be acceptable that the vibration time is determined as the length of time from the start of an excessive state to the time when ink droplets from all nozzles 108 are completely ejected or the length of time until a variation amount V in a total amount of ink droplets ejected from all of the nozzles 108 which eject ink droplets is less than a predetermined value.

Further, the first exemplary embodiment is constituted so that the excessive state detector 65 increases a threshold value k with an increase in ink temperature T. However, such a constitution is also acceptable that the threshold value k is fixed.

Further, the first exemplary embodiment is constituted so that the excessive state detector 65 calculates a pressure difference Pd on the basis of the calculated ink temperature T and variation amount V. Such a constitution is also acceptable that the pressure difference Pd is calculated on the basis of only the variation amount V.

Still further, in the second exemplary embodiment, the vibration time may be given as the length of time from the time when the pressure sensor 18 detects that the pressure of inks exceeds a threshold value k to the time when the pressure returns to a value less than the threshold value k. Thereby, a meniscus can be subjected to vibration only when the vibration is required and for a necessary length of time, which contributes to the reduced consumption of electricity.

In addition, in the first exemplary embodiment, a threshold value k shall not be limited to the pressure of inks as long as it is an index related to a pressure difference Pd. The pressure loss on ink channels will be influenced by change in ink viscosity μ when the flow rate of inks per unit time is the same. The ink viscosity μ is decreased with an increase in ink temperature, and the pressure loss is also decreased. For example, the threshold value k is given as the flow rate of inks per unit time, and the threshold value k may be increased with an increase in ink temperature. The threshold value k is given as the number of ink droplets ejected per unit time, and the threshold value k may be increased with an increase in ink temperature.

As described above, the recording apparatus of the exemplary embodiments is provided with a recording head having a common liquid channel and a plurality of actuators which impart a pressure to a plurality of individual liquid channels extending from an outlet of the common liquid channel via a pressure chamber to a nozzle and a liquid inside the pressure chamber, and control means for controlling the driving of a plurality of the actuators. The control means is provided with excessive state detection means for detecting an excessive state in which droplets are ejected from any one of the nozzles thereby a pressure difference between a liquid-side pressure and an air-side pressure at a meniscus formed at the nozzle exceeds a threshold value, and meniscus vibration means for driving the actuators of the nozzles in such a manner that where the excessive state detection means detects the excessive state, the meniscus formed at all of the nozzles that will not eject droplets is subjected to vibration without ejecting the droplets for the elapse of a predetermined vibration time from the start of the excessive state.

The inventor has found that a meniscus formed at a nozzle is vibrated to increase the pressure resistance of the meniscus. According to the exemplary embodiments, when a large amount of liquid is ejected from nozzles to develop a negative pressure inside a common ink channel, a meniscus formed at a nozzle which will not eject droplets, among nozzles communicatively connected to the common ink channel, is vibrated to increase the pressure resistance of the corresponding meniscus, thus making it possible to downsize a recording head and also prevent the meniscus from being collapsed.

In the exemplary embodiments, it is preferable that the excessive state detection means calculates the pressure difference on the basis of a variation in a total amount of droplets ejected from all of the nozzles that eject the droplets in each unit time. Thereby, it is possible to estimate easily a pressure difference between a liquid-side pressure and an air-side pressure on a meniscus.

In this instance, it is more preferable that the recording apparatus is further provided with temperature detection means for detecting the temperature of a liquid inside the recording head, and the excessive state detection means increases the threshold value with an increase in temperature detected by the temperature detection means. Thereby, it is possible to decide an appropriate threshold value even where there is found a change in viscosity of the liquid depending on the temperature.

In the exemplary embodiments, it is preferable that the control means is further provided with storage means for storing driving data which indicates the size of droplets ejected from the nozzle, and the excessive state detection means determines a total amount of the droplets from the driving data. Thereby, the driving data can be used to estimate more easily a pressure difference between a liquid-side pressure and an air-side pressure on a meniscus.

Further, in the exemplary embodiments, it is more preferable that the meniscus vibration means lengthens the vibration time with an increase in the pressure difference. The time during which a meniscus is vibrated can be changed according to the time during which a negative pressure in excess of the pressure resistance of the meniscus is developed on the individual liquid channels, thus making it possible to save electricity.

Still further, the recording apparatus of the exemplary embodiments is further provided with a liquid supply source which supplies a liquid to the common liquid channel, a supply channel which communicatively connects the liquid supply source with the common liquid channel, and a pressure sensor which measures the pressure of a liquid inside the supply channel. And the excessive state detection means may detect the excessive state on the basis of the pressure of the liquid inside the supply channel measured by the pressure sensor. It is, thereby, possible to detect correctly the excessive state.

It is preferable that where maximum-size droplets are ejected from all of the nozzles and there is balance between an amount of the liquid flowing from all of the nozzles and an amount of the liquid supplied to the common liquid channel, the threshold value is more than a value corresponding to a pressure measured by the pressure sensor and also less than a value corresponding to the pressure difference at which the meniscus is collapsed. It is, thereby, possible to detect correctly a negative pressure developed at which the meniscus can be collapsed on individual liquid channels.

Further, in the exemplary embodiments, the recording head is provided with a plurality of the common liquid channels to which mutually different kinds of liquids are supplied, and at least one of the threshold value and the vibration time may be determined in accordance with any kind of liquid. Thereby, an optimal threshold value and vibration time can be determined, according to characteristics of the liquid. Therefore, it is possible to detect correctly the excessive state on individual liquid channels of each common liquid channel.

What is claimed is:

1. A recording apparatus comprising:

a recording head comprising:

a common liquid channel;

a plurality of pressure chambers;

a plurality of nozzles;

a plurality of individual liquid channels, each of the individual liquid channels being associated with a respective one of the pressure chambers and a respective one of the nozzles, each individual liquid channel extending from an outlet of the common liquid channel via the associated pressure chamber to the associated nozzle; and a plurality of actuators, each of the actuators being associated with the respective one of the pressure chambers and configured to impart a pressure to a liquid inside the respective one of the pressure chambers; and a control unit that is configured to drive the actuators;

wherein the control unit comprises:

an excessive state detection section that is configured to detect an excessive state in which a pressure difference between a liquid-side pressure and an air-side pressure at a meniscus formed at any one of the nozzles exceeds a threshold value when droplets are ejected from the nozzles, and a meniscus vibration section that is configured to drive the actuator associated with the nozzle that does not eject droplets such that the meniscus formed at the nozzle that does not eject droplets is subjected to vibration without ejecting the droplets for a predetermined vibration time from a start of the excessive state when the excessive state detection unit detects the excessive state.

2. The recording apparatus according to claim 1, wherein the excessive state detection section calculates the pressure difference based on a variation amount in a total amount of droplets ejected from all of the nozzles which eject the droplets in each unit time.

3. The recording apparatus according to claim 2, further comprising:

a temperature detection unit that is configured to detect a temperature of a liquid inside the recording head;

wherein the excessive state detection section increases the threshold value with an increase in temperature detected by the temperature detection unit.

4. The recording apparatus according to claim 2, wherein the control unit further comprises a storage section that is configured to store driving data which indicates a size of droplets ejected from the respective nozzles, and the excessive state detection section determines a total amount of the droplets based on the driving data.

5. The recording apparatus according to claim 2, wherein the meniscus vibration section lengthens the vibration time with an increase in the pressure difference.

6. The recording apparatus according to claim 1, further comprising:

a liquid supply source that is configured to supply a liquid to the common liquid channel;

a supply channel that communicatively connects the liquid supply source with the common liquid channel; and a pressure sensor that is configured to measure a pressure of a liquid inside the supply channel;

wherein the excessive state detection unit detects the excessive state based on the pressure of the liquid inside the supply channel measured by the pressure sensor.

7. The recording apparatus according to claim 6, wherein when maximum-size droplets are ejected from all of the nozzles and there is balance between a amount of the liquid flowing from all of the nozzles and an amount of the liquid supplied to the common liquid channel, the threshold value is more than a value corresponding to the pressure measured by the pressure sensor and also less than a value corresponding to the pressure difference at which the meniscus is collapsed.

8. The recording apparatus according to claim 1, wherein the recording head comprises a plurality of the common liquid channels to which mutually different kinds of liquids are supplied, and at least one of the threshold value and the vibration time is determined in accordance with the kind of liquid.

9. The recording apparatus according to claim 1, wherein when the excessive state detection unit detects the excessive state, the meniscus vibration section drives the actuators associated with the nozzles that do not eject droplets such that the menisci formed at all of the nozzles that do not eject droplets are subjected to vibration without ejecting the droplets.

* * * * *